United States Patent [19]

McNeely et al.

[11] Patent Number: 4,846,286

[45] Date of Patent: Jul. 11, 1989

[54] BALL MARK FIXER APPARATUS WITH PIVOTAL TURF GRIPPING ELEMENT

[76] Inventors: John J. McNeely, 413 NW. 2nd St.; David S. Hutton, R.R. #1, P.O. Box 66, both of Casey, Ill. 62420

[21] Appl. No.: 139,438

[22] Filed: Dec. 30, 1987

[51] Int. Cl.[4] ..... A01B 1/24

[52] U.S. Cl. ..... 172/379; 273/32 B; 294/50.9

[58] Field of Search ..... 172/21, 378, 379; 254/131.5, 132; 273/32 B; 294/50.6, 50.7, 50.8, 50.9

[56] References Cited

U.S. PATENT DOCUMENTS

| | | | |
|---|---|---|---|
| 289,186 | 11/1883 | Visscher | 294/50.8 |
| 857,182 | 6/1907 | Lancaster | 294/50.8 |
| 1,244,344 | 10/1917 | Leaman | 294/50.9 |
| 2,020,571 | 11/1935 | Pick | 172/379 X |
| 2,025,254 | 12/1935 | Stuart | 294/50.9 |
| 2,155,839 | 4/1939 | Pride | 294/50.8 |
| 2,790,670 | 4/1957 | Sheets | 294/50.9 |
| 3,152,788 | 10/1964 | Hardwidge | 254/132 |
| 3,164,945 | 1/1965 | Spencer | 56/400.12 |
| 3,276,805 | 10/1966 | Lambert | 294/50.9 X |
| 4,147,329 | 4/1979 | Rodriguez | 294/50.9 X |
| 4,547,010 | 10/1985 | Camp | 294/50.9 |

FOREIGN PATENT DOCUMENTS

| | | | |
|---|---|---|---|
| 775450 | 1/1968 | Canada | 294/50.8 |

*Primary Examiner*—Richard T. Stouffer
*Attorney, Agent, or Firm*—Lalos & Keegan

[57] ABSTRACT

The present invention is directed to an apparatus for fixing ball marks. The apparatus includes a pair of turf gripping elements for moving patches of turf and soil for fixing or filling in ball mark indentations on a golf green. The apparatus is preferably manually actuated through a linkage-lever mechanism for moving the turf gripping elements during a ball mark fixing operation.

7 Claims, 2 Drawing Sheets

BALL MARK FIXER APPARATUS WITH PIVOTAL TURF GRIPPING ELEMENT

BACKGROUND OF THE INVENTION

The present invention is directed to an apparatus for fixing ball marks that readily occur on golf greens during normal play on a typical golf course.

Ball marks occur as a result of a player attempting to drive his or her ball onto the green during play on a short hole or attempting a chip shot onto the green after a number of strokes on a long hole. Ball marks are basically indentations in the surface of a golf green resulting from the ball landing on the golf green with sufficient force to locally compress the turf and/or soil underneath the turf on impact.

There exists a number of conventional devices or apparatus for fixing ball marks. One such apparatus is disclosed in U.S. Pat. No. 3,567,264 to G. L. Baber comprising a plurality of radially extending blades pivotably mounted to a center hub and simultaneously activated through a linkage mechanism upon pressing down on a handle of the apparatus moving the tips of the blades radially inwardly and downwardly. This movement of the blades tend to fill in the ball mark by moving surrounding turf and soil radially inwardly into the region of the ball mark. Another conventional device is disclosed in U.S. Pat. No. 3,168,150 to Kappler having a plurality of radially inwardly moving fingers actuated by a camming mechanism upon pressing the handle of the device downwardly to move turf and soil radially inwardly into the region of the ball mark for leveling off the indentation in the golf green.

Both of the above referred to conventional apparatus have substantially complicated mechanisms to actuate blade tips and/or fingers for movement radially inwardly to dislodge the turf and soil from around the region of the ball mark, into the region of the ball mark, so as to level off the indentation in the golf green. The present invention utilizes a more simple mechanism for achieving the same result of filling in the indentation of the ball mark in the golf green. The simplicity of design provides a substantially more durable and reliable tool that is less susceptible to damage during a long work life as is typical during use by a golf green grounds keeper. Further, the present apparatus functions somewhat differently than the above referred to conventional apparatus in that the present invention displaces a patch of turf and soil into the location of the ball mark indentation as opposed to a plurality of small areas of turf and soil positioned inwardly of the blade tips and/or fingertips of the above referred to conventional apparatus.

Movement of the blade tips or fingertips of the prior art devices tend to cut or tear through the turf and soil as opposed to the present apparatus that moves an interconnected patch(es) of turf and soil as a unit preventing substantial root and/or damage to the grass blades of the turf.

SUMMARY OF THE INVENTION

An object of the present invention is to provide an improved ball mark fixing apparatus.

Another object of the present invention is to provide a ball mark fixing apparatus that provides movement of an interconnected patch of turf and soil into the region of the ball mark and/or damaged area of a golf green.

A further object of the present invention is to provide a ball mark fixing apparatus comprising an elongated handle having a first turf gripping element and a lever pivotably mounted to the elongated handle, said lever having a second turf gripping element with the elongated handle and lever having a scissor-like action for moving at least one patch of grass and soil with one or both of the turf gripping elements during a ball mark fixing operation.

A still further object of the present is to provide a ball mark fixing apparatus comprising an elongated handle; a lever pivotably mounted on said elongated handle; a first turf gripping element attached to one end of said elongated handle; a second turf gripping element attached to one end of said lever; lever actuating means for moving said first and second turf gripping elements together during a ball mark fixing operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings that are given by way of illustration only, and thus are not limitative of the present invention, and wherein.

DETAILED DESCRIPTION OF THE PREFERRED EMBODIMENT

Figure 1:
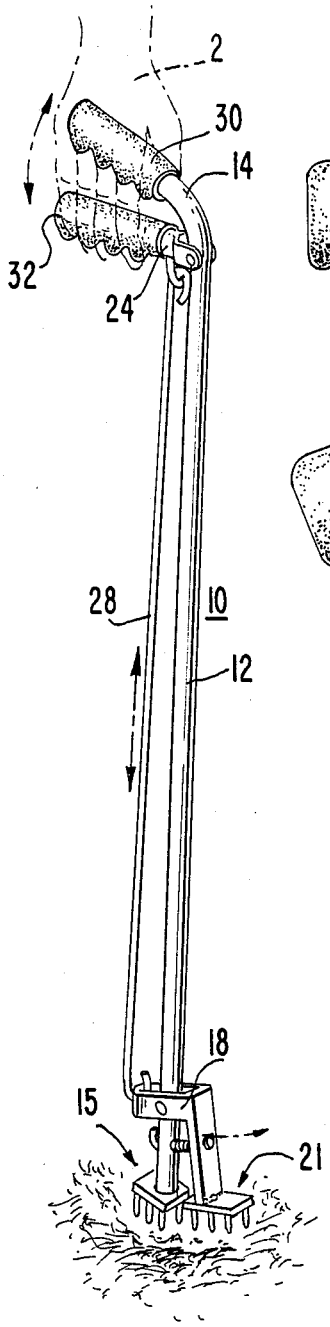
FIG. 1 is a perspective view of the apparatus of the present invention during use.
Figure 2:
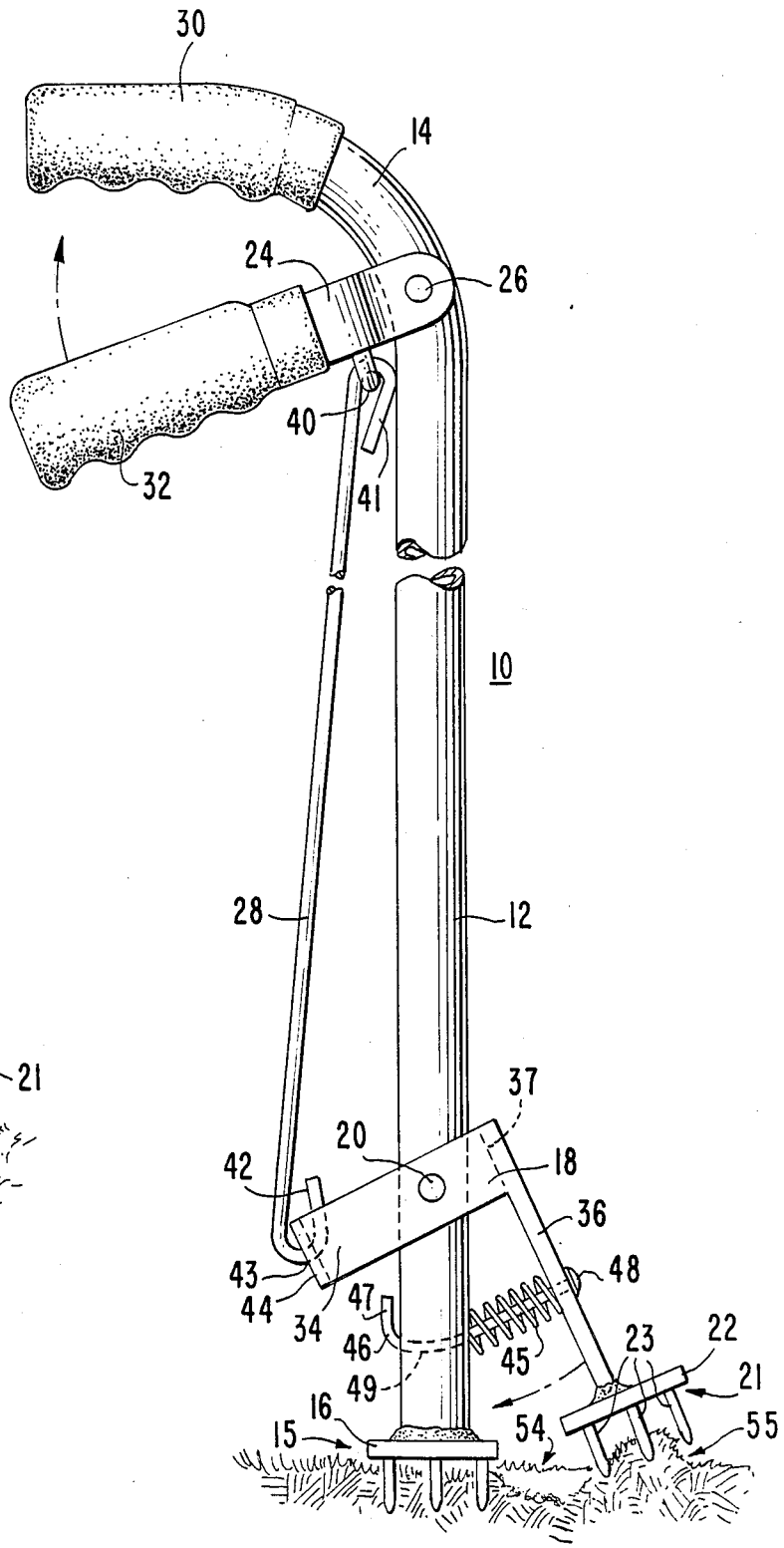
FIG. 2 is a side view, partly broken away, of the apparatus of the present invention as it is about to engage the turf behind the ball indentation, also partly broken away.

FIG. 1 shows a perspective view of the ball mark fixing apparatus during use and operated manually by a hand 2 of a user. FIG. 2 shows the ball mark fixing apparatus 10 comprising a shaft 12 preferably having a handle 14. The handle 14 is preferably positioned at an angle with respect to shaft 12 to allow the user easily to position the shaft 12 substantially perpendicular with respect to the ground. A turf gripping element 15 such as plate 16 having a plurality of spikes 17 extending from one side thereof is affixed to the bottom of the shaft 12.

A lever 18 is pivotably mounted at pivot 20 to a lower portion of the shaft 12. Attached to one end of the lever 18 is another turf gripping element 21 such as plate 22 having a plurality of spikes 23 extending from one side thereof. The apparatus 10, is manually actuated by means of a hand grip shaft 24 acting as a hand grip pivotably mounted to an upper portion of the shaft 12 at pivot 26. A linkage rod 28 connects the shaft 24 to an opposite end of the lever 18. Both the handle 14 and hand grip shaft 24 can be provided with hand grips 30, 32 made of material such as plastic, rubber, foamed plastic materials or other materials that would provide a sure hand grip.

Figure 3:
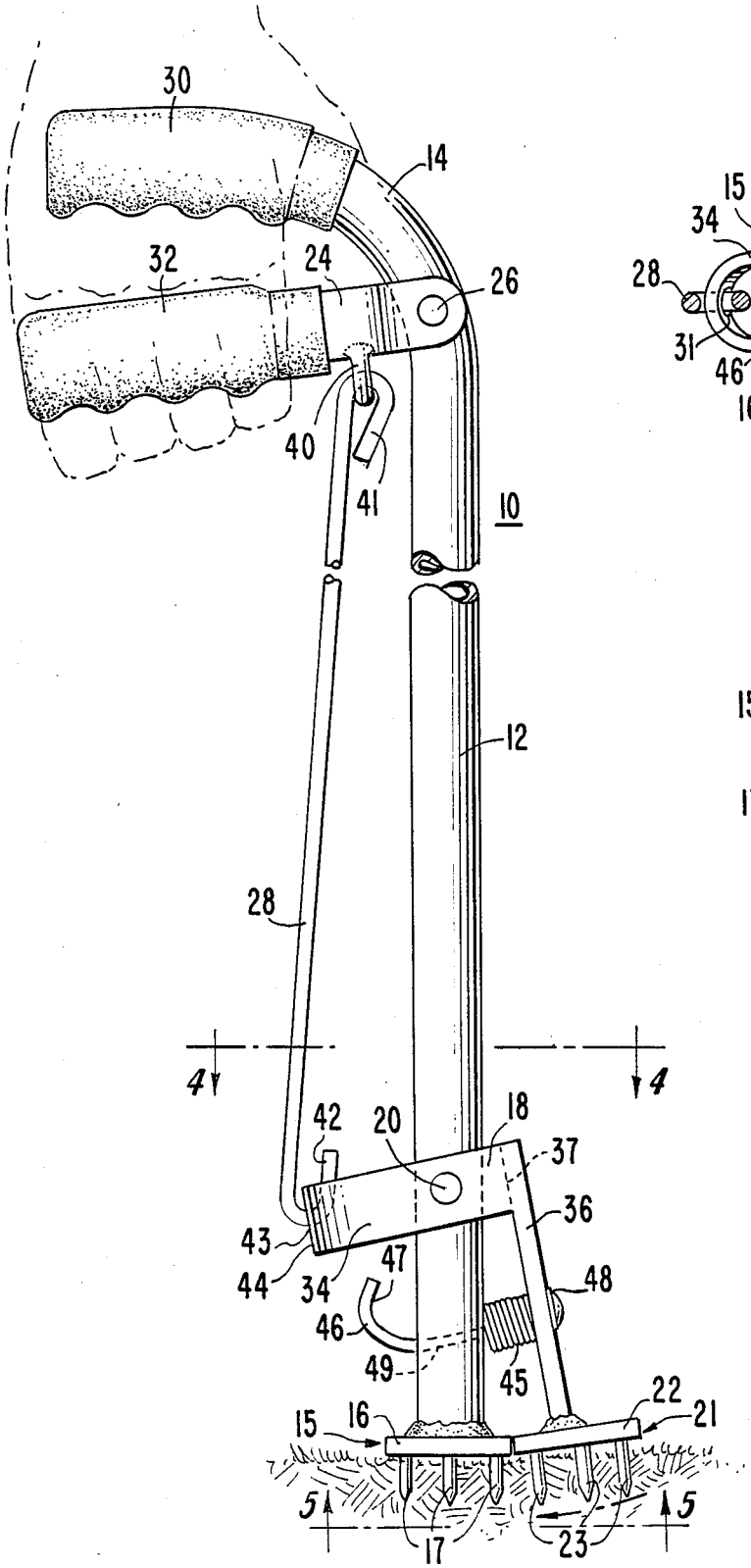
FIG. 3 is another side view of the apparatus of the present invention upon completion of the leveling of the indentation.
Figure 4:
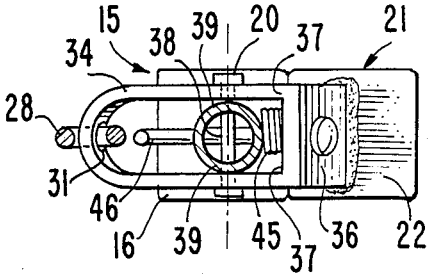
FIG. 4 is a cross-sectional view of the apparatus of the present invention taken along lines 4—4 of FIG. 3.

FIGS. 3 and 4 show the detailed features of the lever 18. The lever 18 comprises a yoke 34 in the form of a bifurcated continuous strip of metal in which the shaft 12 is pivotably disposed about pivot 20, and an arm 36 in the form of a metal bar is attached at the ends 37, 37 of the yoke 34 and being positioned substantially perpendicularly to the yoke 34.

In the preferred embodiment of the present invention, the yoke 34 is secured to arm 36 as by butt welding the ends 37, 37 of the yoke 34. Also, both pivots 20 and 26 are preferably defined by double-headed pins, such as pin 38 as illustrated in FIG. 4, passed through a set of holes 39, 39 in shaft 12.

The linkage rod 28 is connected to hand grip shaft 24 by means of a metal wire loop 40 attached a by welding to hand grip shaft 24. A looped end 41 of linkage rod 28 is passed through loop 25 as by bending during assembly of the apparatus for securing the linkage rod 28 to the hand grip shaft 24. At an opposite end of linkage rod 28, a looped end 42 is passed through a hole 43 provided in end 44 of yoke 34 as by bending during assembly of the present apparatus for securing the linkage rod 28 to lever 18.

The arm 36 of the lever 18 is biased away from the elongated handle 12 about pivot 20 by means of a spring 45 as shown in FIG. 3. The spring 45 is guided and supported in a position between the arm 36 and the shaft 12 by means of a wire rod 46. The wire rod 46 includes a free end 47 and a head 48 secured as by welding to the arm 36. The shaft 12 is provided with a hole 49 through which wire rod 46 is slidably disposed. Further, the wire rod 42 is arcuately shaped along its length so as not to bind during sliding movement through the hole 49 in the shaft 12, due to pivotal movement of the lever 18 about the pivot 20 relative to shaft 12.

Figure 5:
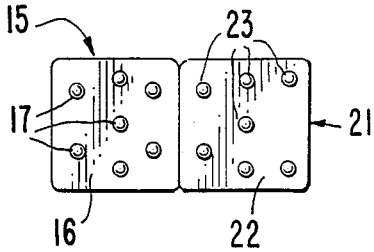
FIG. 5 is a bottom view taken along lines 5—5 of FIG. 3 of a pair of turf gripping elements of the apparatus of the present invention.
Figure 6:
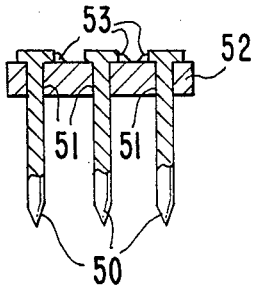
FIG. 6 is a cross-sectional view of a turf gripping element according to the present invention.

Details of the turf gripping elements 15, 21 are shown in FIGS. 3 and 5. Each turf gripping element comprises a plate 16, 22 and a plurality of spikes 17, 23, respectively, for engaging with a patch of turf and soil. Preferably, each turf gripping element 15, 21 consists of a plate 16, 22 of metal welded to and positioned transversely to the elongated handle 12 and elongated member 36, respectively, for contact with the top of the ground, as shown in FIG. 3. With respect to plate 16, handle 12 extends generally vertically away from the plane defined by that plate. A plurality of nails 50 can be utilized as spikes, and passed through a plurality of holes 51 previously provided in metal plate 52 coextensive with the spikes in the assembly of the turf gripping element according to the present invention as shown in FIG. 6. The nails are secured in place by spot welds 53 during assembly of this particular turf gripping element. One arrangement of the spikes is shown in FIG. 5. In that figure, each turf gripping element is illustrated with the spikes positioned in three groups of two or more spikes. The groups are arranged transversely to the direction of pivotal movement of turf gripping element 21. In the intermediate group of spikes, for each turf gripping element, one of the spikes is closer to the axial plane of movement than the rest of the spikes on that turf gripping element.

OPERATION OF THE APPARATUS

The best mode of operation of the present invention includes the steps of a user first anchoring the turf gripping element 15 including plate 16 and spikes 17 into a patch of turf and soil on one side of indentation 54, as shown in FIG. 2, by pressing firmly downwardly on the handle 14 that in turn drives the shaft 12 downwardly. Upon pivoting the shaft 12 with respect to the ground and with the turf gripping element 15 anchored into a patch of turf and soil acting as a pivot point for the apparatus, the turf gripping element 21 engages with another patch of turf and soil such as the raised mound 55 resulting from impact by a golf ball moving in the rightward direction with the ground located adjacent to but on the opposite side of indentation 54. The user then actuates the lever 18 by gripping hand grip 32 provided on the hand grip shaft 24 with the user's fingers while the hand grip 30 provided on the handle 14 is positioned securely within the palm of the user's hand, and then squeezing the hand grip shaft 24 towards the handle 14. This actuation, controlled by the user, results in the lever 18 being pivoted by the linkage rod 28 and the arm 36 pivoting towards the shaft 12.

As a result of the actuation of the elements of the present apparatus, the turf gripping element 21 displaces the raised mound 55 on the opposite side of the indentation 54, towards the patch of turf and soil anchored in position by means of the turf gripping element 15 into indentation 54 repairing the ball mark.

In another mode of operation of the present invention, shaft 12 can be positioned relative to the ground such that the anchoring ability of each turf gripping element 15, 21 is approximately the same. The patches of turf and soil located beneath each turf gripping element 15, 21 both move upon actuation of the device towards a midpoint location defined as a midpoint between the turf gripping elements 15, 21 in the open position, before actuation, of the present apparatus.

The apparatus can be alternatively operated by anchoring the patch of turf and soil located beneath the turf gripping element 21 and actuating the apparatus so that the patch of turf and soil located beneath the turf gripping element 15 is transported to a location adjacent to the patch of soil anchored beneath the turf gripping element 21. Thus, a multiplicity of different modes of operation can be had by the present apparatus for mending different types of ball marks depending on their specific nature.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A ball mark fixing apparatus for a ball mark in the ground, comprising:

an elongated shaft;

a lever pivotably mounted on said elongated shaft and having first and second ends;

a first turf gripping element attached to one end of said shaft;

a second turf gripping element attached to said first end of said lever;

said second turf gripping element having a first plurality of turf engaging spikes for actuation to fix a ball mark, said first turf gripping element including a second plurality of turf engaging spikes and a first plate transversely positioned relative to said shaft, said first plate being fixed to said shaft such that said shaft extends generally vertically away from the plane defined by said first plate, said first plate supporting said second plurality of spikes in a stationary position upon said apparatus being actuated to fix said ball mark, said first plate being coextensive over said second plurality of spikes for contact with the ground of a ball mark, a second plate secured to the first end of said lever, said second plate supporting said first plurality of spikes for contact with the top of the ground, actuating means for actuating said lever and causing relative movement between said first and second turf gripping elements to effect a ball mark fixing, said actuating means including a hand grip shaft, one end of said hand grip shaft being pivotally mounted adjacent an opposite end of said shaft to said one end of said shaft and a linkage rod connected between said second end of said lever and said hand grip shaft.

2. The apparatus according to claim 1, wherein said lever includes a yoke pivotably disposed about said shaft and an arm extending from one end of said yoke, said second turf gripping element being attached to a free end of said arm.

3. The apparatus according to claim 1, wherein said shaft includes a handle disposed at an angle relative to said shaft.

4. The apparatus according to claim 1, includes a biasing means for biasing said first and second turf gripping elements apart.

5. The apparatus according to claim 4, wherein said biasing means comprises a spring disposed between said shaft and said lever, including an arcuately shaped wire rod attached to said lever, said shaft having a hole through which said wire is slidably disposed for securing and guiding said spring.

6. A ball mark fixing apparatus for a ball mark in the ground, comprising:

an elongated shaft;

a lever pivotably mounted on said elongated shaft and having first and second ends;

a first turf gripping element attached to one end of said shaft;

a second turf gripping element attached to said first end of said lever;

said second turf gripping element having a plurality of turf engaging spikes with each of said spikes extending away from said elongated shaft in the direction of the axis of said shaft with actuation of said second turf gripping element causing pivotal movement of said second turf gripping element with respect to said shaft to fix a ball mark, said spikes being positioned is at least several groups transverse to the direction of movement of said second turf gripping element with each of said groups being comprised of a plurality of said spikes during said actuation, at least one of said spikes being closer to the axial plane of the movement of said second turf gripping element during said actuation than the others of said spikes, said at least one spike being in one of said groups intermediate to two others of said groups in the direction of said movement, and actuating means for pivoting said lever and causing said actuation of said second turf gripping element, resulting in relative motion between said first and second turf gripping elements to effect a ball mark fixing.

7. The apparatus according to claim 4, wherein said actuating means includes a hand grip shaft, one end of said hand grip shaft being pivotably mounted adjacent an opposite end of said shaft, and a linkage rod connected between said second end of said lever and said hand grip shaft.

* * * * *